US008349267B2

(12) United States Patent
Cody et al.

(10) Patent No.: US 8,349,267 B2
(45) Date of Patent: Jan. 8, 2013

(54) CRUDE OIL PRE-HEAT TRAIN WITH IMPROVED HEAT TRANSFER

(75) Inventors: Ian A Cody, Annandale, NJ (US); Amar S. Wanni, Antwerp (BE); Robert C. Welch, Baton Rouge, LA (US); James E. Feather, Burke, VA (US); Mark A. Greaney, Upper Black Eddy, PA (US); Limin Song, West Windsor, NJ (US); Jasmina Poturovic, Calgary (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 692 days.

(21) Appl. No.: 12/232,946

(22) Filed: Sep. 26, 2008

(65) Prior Publication Data

US 2009/0090613 A1 Apr. 9, 2009

Related U.S. Application Data

(60) Provisional application No. 60/960,603, filed on Oct. 5, 2007.

(51) Int. Cl.
*B01J 8/00* (2006.01)

(52) U.S. Cl. ..... 422/201; 422/310; 208/48 R; 208/308; 208/309; 165/84; 165/95

(58) Field of Classification Search ..... 208/48 R, 208/308, 309; 422/201, 127, 310; 165/84, 165/95; 196/98, 155
See application file for complete search history.

(56) References Cited

U.S. PATENT DOCUMENTS

| | | | | |
|---|---|---|---|---|
| 3,183,967 | A | 5/1965 | Mettenleiter | |
| 3,819,740 | A | 6/1974 | Hori | |
| 3,835,817 | A | 9/1974 | Tuomaala | |
| 3,888,760 | A * | 6/1975 | Ebert | 208/48 R |
| 4,024,051 | A | 5/1977 | Shell et al. | |
| 4,142,579 | A | 3/1979 | Kazanovich et al. | |
| 4,162,617 | A | 7/1979 | Schmidt et al. | |
| 4,271,007 | A | 6/1981 | Souhrada et al. | |
| 4,461,651 | A | 7/1984 | Hall | |
| 4,502,787 | A | 3/1985 | Broadhurst | |

(Continued)

FOREIGN PATENT DOCUMENTS

DE 19606011 A1 8/1997

(Continued)

OTHER PUBLICATIONS

International Search Report, PCT/US2008/011395, mailed Jan. 14, 2009.

(Continued)

*Primary Examiner* — Nina Bhat
(74) *Attorney, Agent, or Firm* — Glenn T. Barrett

(57) ABSTRACT

Targeted application of anti-fouling mechanisms in a heat exchange system produces higher rates of energy recovery. The anti-fouling mechanisms with high mitigation rates can be deployed at only the hottest portions of a pre-heat train that experience the highest rates of fouling and heat loss. In application, bundles of corrosion resistant smoothed tubes are deployed in the late pre-heat train to significantly reduce the formation of harder deposits. Vibration can be used as an adjunct approach in conjunction with the corrosion resistant, smooth tubes, or deployed alone on existing bundles. The use of high performing, more durable exchangers in select locations justifies the increased cost of these components.

14 Claims, 5 Drawing Sheets

U.S. PATENT DOCUMENTS

| | | | | |
|---|---|---|---|---|
| 4,505,017 | A | 3/1985 | Schukei | |
| 4,645,542 | A | 2/1987 | Scharton et al. | |
| 4,655,846 | A | 4/1987 | Scharton et al. | |
| 4,795,551 | A * | 1/1989 | Hamilton et al. | 208/309 |
| 4,891,190 | A | 1/1990 | Carter et al. | |
| 5,287,915 | A | 2/1994 | Liu et al. | |
| 5,540,275 | A | 7/1996 | Eisinger | |
| 5,674,323 | A | 10/1997 | Garcia | |
| 5,873,408 | A * | 2/1999 | Bellet et al. | 165/84 |
| 7,726,871 | B2 * | 6/2010 | Song et al. | 366/116 |
| 7,919,058 | B2 * | 4/2011 | Brons et al. | 422/211 |
| 2006/0219598 | A1 * | 10/2006 | Cody et al. | 208/255 |
| 2007/0251249 | A1 | 11/2007 | Burk | |
| 2008/0073063 | A1 * | 3/2008 | Clavenna et al. | 165/84 |

FOREIGN PATENT DOCUMENTS

| | | | |
|---|---|---|---|
| DE | 10318528 | A1 | 11/2004 |
| EP | 0022349 | A | 1/1981 |
| EP | 0698653 | A | 2/1996 |
| EP | 0716282 | A | 6/1996 |
| EP | 0780656 | A | 6/1997 |
| EP | 1052307 | A | 11/2000 |
| EP | 1167866 | A | 2/2002 |
| EP | 1219912 | A | 7/2002 |
| EP | 1265048 | A | 11/2002 |
| EP | 1798511 | A | 6/2007 |
| FR | 2795337 | A1 | 12/2000 |
| FR | 2795748 | A | 1/2001 |
| GB | 453870 | | 9/1936 |
| GB | 532144 | A | 1/1941 |
| GB | 846994 | | 9/1960 |
| GB | 1099742 | A | 1/1968 |
| GB | 1247429 | A | 9/1971 |
| GB | 2147078 | A | 5/1985 |
| GB | 2152204 | A | 7/1985 |
| JP | 60023794 | | 2/1985 |
| JP | 62017169 | A | 1/1987 |
| WO | 9816792 | A | 4/1998 |
| WO | 0045965 | A | 8/2000 |
| WO | 0208498 | A | 1/2002 |
| WO | WO 02/34862 | A | 5/2002 |
| WO | 2006034876 | | 4/2006 |

OTHER PUBLICATIONS

Written Opinion, PCT/US2008/011395, mailed Jan. 14, 2009.

* cited by examiner

CRUDE OIL PRE-HEAT TRAIN WITH IMPROVED HEAT TRANSFER

CROSS REFERENCE TO RELATED APPLICATION

This application relates to and claims priority to U.S. Provisional Patent Application No. 60/960,603, filed on Oct. 5, 2007.

BACKGROUND OF THE INVENTION

1. Field of the Invention

This invention relates to heat exchange devices, particularly heat exchange devices disposed in refinery or petrochemical operations that are subject to fouling. The invention especially relates to the design of a pre-heat train upstream of a crude oil distillation operation.

2. Discussion of Related Art

Fouling is generally defined as the accumulation of unwanted materials on the surfaces of processing equipment. In petroleum processing, fouling is the accumulation of unwanted hydrocarbon-based deposits and inorganic deposits, such as salts and products of corrosion reactions, on heat exchanger surfaces. It has been recognized as a nearly universal problem in design and operation of refining and petrochemical processing systems, and affects the operation of equipment in two ways. First, the fouling layer has a low thermal conductivity. This increases the resistance to heat transfer and reduces the effectiveness of the heat exchangers. Second, as deposition occurs, the cross-sectional area is reduced, which causes an increase in pressure drop across the apparatus and creates inefficient flow in the heat exchanger.

Fouling in heat exchangers associated with petroleum type streams can result from a number of mechanisms including chemical reactions, corrosion, deposit of insoluble materials, and deposit of materials made insoluble by the temperature difference between the fluid and heat exchange wall. One of the more common root causes of rapid fouling, in particular, is the formation of coke that occurs when crude oil asphaltenes are overexposed to heater tube surface temperatures. The liquids on the other side of the exchanger are much hotter than the whole crude oils and result in relatively high surface or skin temperatures. The asphaltenes can precipitate from the oil and adhere to these hot surfaces. Prolonged exposure to such surface temperatures, especially in the latter section of the pre-heat train, or the so-called late-train exchangers, allows for the thermal degradation of the asphaltenes to coke. The coke then acts as an insulator and is responsible for heat transfer efficiency losses in the heat exchanger by preventing the surface from heating the oil passing through the unit. To return the refinery to more profitable levels, the fouled heat exchangers need to be cleaned, which typically requires removal from service, as discussed below.

Heat exchanger in-tube fouling costs petroleum refineries hundreds of millions of dollars each year due to lost efficiencies, throughput, and additional energy consumption. With the increased cost of energy, heat exchanger fouling has a greater impact on process profitability. Petroleum refineries and petrochemical plants also suffer high operating costs due to cleaning required as a result of fouling that occurs during thermal processing of whole crude oils, blends and fractions in heat transfer equipment. While many types of refinery equipment are affected by fouling, cost estimates have shown that the majority of profit losses occur due to the fouling of whole crude oils and blends in pre-heat train exchangers.

The pre-heat train is particularly susceptible to fouling, and loss of efficiency of heat transfer at this stage impacts the entire operation. It could be estimated that fouling and corrosion of heat exchangers in the crude pre-heat train leading to the furnace for the crude distillation unit exacts an energy penalty of greater than 100 MBtu/hr in a typical 100 kBD crude train. Furnace firing often limits throughput in crude units and coking units so the effects of fouling can be felt downstream as well.

Currently, most refineries practice off-line cleaning of heat exchanger tube bundles by bringing the heat exchanger out of service to perform chemical or mechanical cleaning. The cleaning can be based on scheduled time or usage or on actual monitored fouling conditions. Such conditions can be determined by evaluating the loss of heat exchange efficiency. However, off-line cleaning interrupts service. This can be particularly burdensome for small refineries because there will be periods of reduced or non-production.

Rigorous cleaning and hardware solutions can be costly and offer limited advantages over existing approaches. One existing approach utilizes carbon steel (CS) or chromium (Cr) containing ferritic steels, such as 5Cr and 9Cr, which can produce marginal benefits over standard exchangers. Other approaches have been attempted such as providing protective metal oxide films on surfaces susceptible to fouling. Known approaches vary in effectiveness and economic viability. Since the pre-heat train can include many heat exchangers, replacing or treating every heat exchanger in the pre-heat train can be extremely costly and may not yield sufficiently high mitigation results to justify the added expense.

Attempts have also been made to use vibrational forces to reduce fouling in heat exchangers. The basis for using vibration is to provide a mechanism by which motion is induced in the liquid in the tubes to disrupt the formation of deposits on the surface of the heat exchanger.

Mitigating or possibly eliminating fouling of heat exchangers can result in huge cost savings in energy reduction alone. Reduction in fouling leads to energy savings, higher capacity, reduction in maintenance, lower cleaning expenses, and an improvement in overall availability of the equipment.

There is a need to develop additional methods for reducing the effects of fouling and increase energy recovery. There is also a need for developing a system that is economically viable, especially in large applications such as refineries with many heat exchangers.

BRIEF SUMMARY OF THE INVENTION

The invention is directed to a method of reducing energy loss, comprising providing a plurality of heat exchangers to form a pre-heat train for a fluid flow that forms fouling deposits, selecting at least one, and less than all, of the heat exchangers for fouling mitigation based on at least one of the temperature experienced by the heat exchanger, the intended degree of fouling mitigation, and the location in the pre-heat train, and providing only the selected heat exchangers with an anti-fouling mechanism.

In accordance with the method, selecting the heat exchanger for fouling mitigation can include selecting the heat exchanger that experiences the highest temperatures, selecting the heat exchanger at the hottest point in the pre-heat train, or selecting the heat exchanger adjacent to a furnace. Selecting the heat exchangers can also include selecting at most 40% of the heat exchangers.

Providing the anti-fouling mechanism can include providing a mechanism with at least 75% mitigation of fouling deposits, or preferably at least 90% mitigation of fouling deposits.

Providing the anti-fouling mechanism can include providing a bundle of tubes in a tube and shell type heat exchanger that have a smoothed corrosion resistant surface. Providing the anti-fouling mechanism can include applying vibration to the heat exchanger.

The invention is also directed to a crude oil processing system, comprising a plurality of heat exchangers defining a pre-heat train arranged along a crude oil flowpath having an upstream end and a downstream end for progressively heating a flow of crude oil, and a furnace for heating the crude oil for processing, wherein the furnace is disposed at the downstream end of the crude oil flowpath at the end of the pre-heat train, and wherein the portion of the pre-heat train disposed adjacent to the furnace at the downstream end of the flowpath includes a heat exchanger having an anti-fouling mechanism and the remaining portion of the pre-heat train includes a heat exchanger having no anti-fouling mechanism.

The plurality of heat exchangers can include tube and shell type heat exchangers, and the anti-fouling mechanism can include a tube bundle made of corrosion resistant smoothed tubes. The anti-fouling mechanism can also include a vibration applicator.

In this system, at most 40% of the heat exchangers in the pre-heat train can have anti-fouling mechanisms and exhibit benefits. The heat exchanger in the pre-heat train at the downstream end directly adjacent to the furnace can have the anti-fouling mechanism. The anti-fouling mechanism can mitigates fouling by at least 75%, or preferably by about 90%.

The heat exchanger in the pre-heat train that experiences the highest temperature in the pre-heat train can have the anti-fouling mechanism.

The crude oil processing system can further include a distillation tower in fluid communication with the heat exchangers, and process streams drawn from the distillation tower can be routed through at least some of the heat exchangers. The system can be combined with a refinery.

The invention is additionally directed to a heat exchange assembly, comprising a plurality of heat exchangers disposed in a train along a flow path, wherein the train has a cool end and a hot end, and wherein one portion of the train at the hot end includes at least one heat exchanger including an anti-fouling mechanism that mitigates at least 75% of fouling deposits and the remaining portion of the train includes heat exchangers that mitigate fouling deposits in a range of less than 75% to none.

The heat exchanger including the anti-fouling mechanism can mitigate at a level of at least 90%. The anti-fouling mechanism can include a heat exchange surface that is smoothed and corrosion resistant to resist adherence of fouling deposits and/or a vibration actuator that induces vibrations within the heat exchanger to inhibit adherence of fouling deposits on a heat exchange surface.

These and other aspects of the invention will become apparent when taken in conjunction with the detailed description and appended drawings.

BRIEF DESCRIPTION OF THE DRAWINGS

The invention will now be described in conjunction with the accompanying drawings in which.

In the drawings, like reference numerals indicate corresponding parts in the different figures.

DETAILED DESCRIPTION OF PREFERRED EMBODIMENTS

Figure 1:
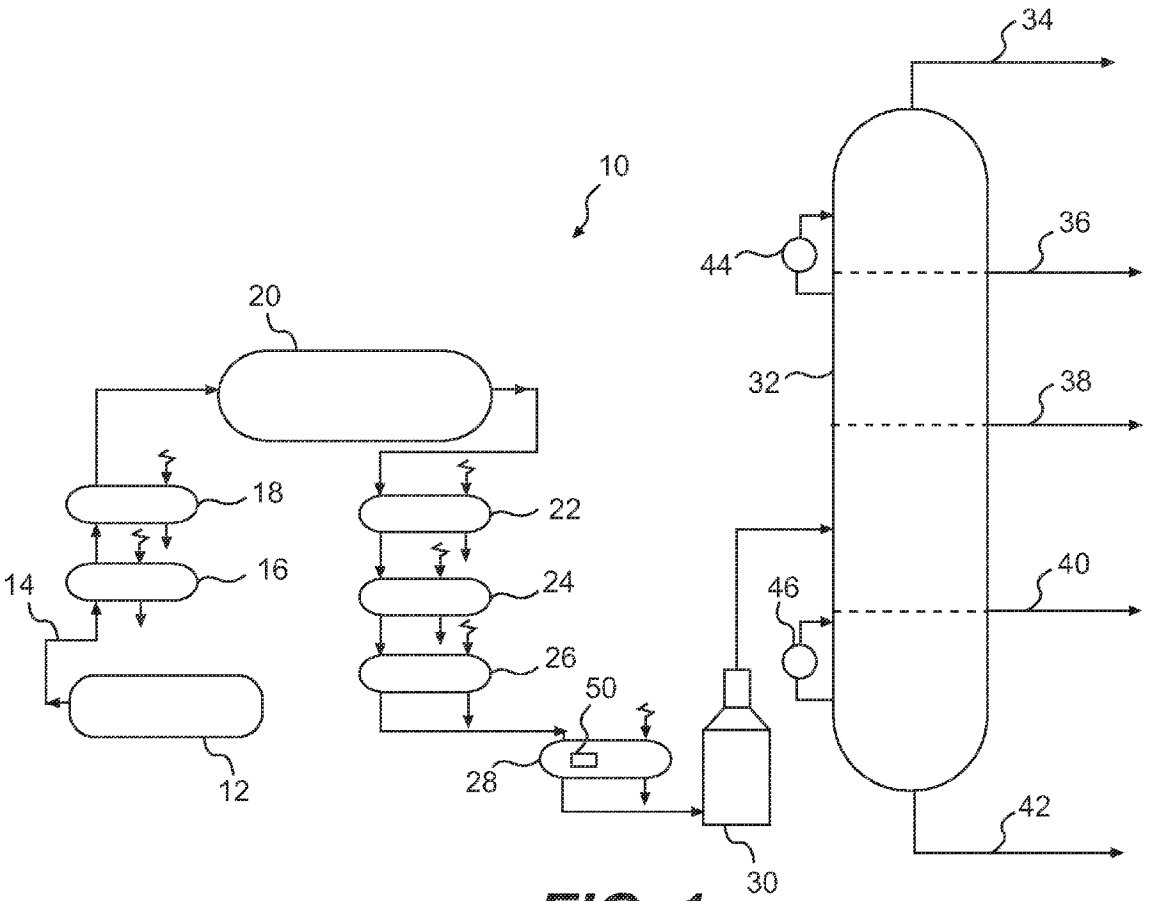
FIG. 1 is a schematic view of pre-heat train leading to a distillation column in accordance with one arrangement of the operation.

The invention is directed to a hardware solution and method of implementing the solution for recovering energy losses associated with fouling. The solution is applicable to various operations that experience fouling in heat exchangers, especially operations that use a train or series of heat exchangers for progressively increased heating. One implementation is directed to a pre-heat train formed of a plurality of heat exchangers that lead to a furnace, and ultimately to a crude oil distillation column.

The concept disclosed herein, however, can be implemented in various operations that would benefit from a targeted approach to recovery of energy losses. For example, the concepts disclosed herein could be implemented in any train of heat exchangers, including a train that leads to other operations in a refining process. It is also applicable to other processes that experience fouling in a similar manner as experienced during refining processes and especially those that are inconvenient to take off-line for repair and cleaning. It will be appreciated by those of skill in the art that the invention can be broadly applied.

The invention can be applied to any type of equipment that experiences fouling, especially all types of heat exchange devices. For example, many refineries use shell-tube type heat exchangers in which a bundle of individual tubes are supported by a tube sheet and are retained within a shell. The wall surfaces of the tubes, including both the inside and the outside surfaces, are susceptible to fouling or the accumulation of unwanted hydrocarbon based deposits. It will be recognized by those of ordinary skill in the heat exchanger art that while a shell-tube exchanger is described herein as an exemplary embodiment, the invention can be applied to any heat exchanger surface in various types of known heat exchanger devices including plate type exchangers. Accordingly, the invention should not be limited to shell-type exchangers.

A typical crude oil distillation operation uses a crude oil pre-heat train to heat the cold crude oil obtained from storage before it reaches the distillation column. The crude oil is pumped from the storage unit, through a desalter, and into a furnace before entering the distillation column. An intermediate flash tower or drum may be present between the desalter and the furnace. This feed path is commonly known as the pre-heat train as it also includes a plurality of heat exchangers that progressively heat the raw crude oil flow as it traverses from storage to the furnace.

Heat exchange with crude oil involves two important fouling mechanisms: chemical reaction and the deposition of insoluble materials. In both instances, the reduction of the viscous sub-layer (or boundary layer) close to the wall can mitigate the fouling rate. In the case of chemical reaction, the high temperature at the surface of the heat transfer wall activates the molecules to form precursors for the fouling residue. If these precursors are not swept out of the relatively stagnant wall region, they will associate together and deposit on the wall. A reduction of the boundary layer will reduce the thickness of the stagnant region and hence reduce the amount of precursors available to form a fouling residue. So, one way to prevent adherence is to provide smooth, corrosion resistant surfaces that resist the adherence of potential foulants. Anther way is to disrupt the film layer at the surface to reduce the exposure time at the high surface temperature by introducing energy into the system.

The pre-heat train is especially prone to severe fouling due to both the raw crude oil stream in the tubes and the process streams used for heating in the shell. The pre-heat train also experiences very high temperatures in certain sections. The loss of efficiency in the pre-heat train due to fouling is extremely expensive and impacts the efficiency, costs and environmental impact of the entire refining operation.

Total potential savings of mitigating fouling in the pre-heat train is based on savings from direct fouling costs, including energy costs and environmental impact, production loss during shut-downs, capital expenditure for excess surface area of heat exchangers, and maintenance costs, and savings from operating a thermally more efficient crude pre-heat rain due to improved heat recovery, which reduces furnace heat input.

FIG. 1 shows one possible configuration of a pre-heat train 10 used in the first step in a refining operation. Typically, the first step includes distilling the raw crude oil. The raw crude oil is pumped from a storage unit 12 through a feed path 14 that leads, in this case, to a first heat exchanger 16 and a second heat exchanger 18 arranged in series.

The heated raw crude oil is then pumped to a desalter 20, as is known, to remove salts. The raw crude, which normally contains water and salt, is mixed with a water stream and is intensely mixed. The desalter 20 then typically uses an electric field to separate the crude from the water droplets. As the desalter 20 works best at 120-150° C., for example, it is placed in the middle of the pre-heat train so that the crude oil entering the desalter 20 is heated.

The desalted crude oil is then transported downstream and further heated in a series of heat exchangers. In the example shown in FIG. 1, a plurality of heat exchangers 22, 24, 26, and 28 are arranged in series and lead to the furnace 30. Of course, any number or arrangement of heat exchangers may be used depending on the particular pre-heat train design characteristics and the efficiency of the individual exchangers. Additionally, as noted above, an intermediate flash tower or drum may be present in the pre-heat train as well. Typically, the crude oil will be heated to temperatures of about 200-280° C. by the heat exchangers before entering the furnace 30.

The heated crude oil then enters the distillation column 32. The crude is heated further in the column 32 to temperatures of about 330-370° C. for separation into a number of fractions, each having a particular boiling range, that are drawn off as individual process streams. Conventionally, a vacuum unit will operate in series with the distillation unit.

The inside of the column 32 has a series of horizontal trays that facilitate separation or fractionation of the crude oil into fractions. The column 32 is very hot at the bottom, with the temperature gradually reducing toward the top so that each tray has a different temperature and will act on the different hydrocarbons in the crude oil that boil at different temperatures. Most of the fractions will vaporize and rise through the trays in the columns. Each fraction will condense and change to liquid phase at the tray where the temperature is just below its particular boiling point. The heaviest fractions condense on the lower trays and the lighter fractions condense on the upper trays. The fractions are drawn off at different elevations in the columns through gravity for further processing. The vapors leave the top of the column 32 through a pipe 34 and are routed to an overhead condenser. A mixture of gas, liquid naphtha, and liquid water exits the condenser.

As seen in FIG. 1, the next fraction to be drawn off at outlet 36 is kerosene, followed by light gas oil at outlet 38, and heavy gas oil at outlet 40. Reduced crude oil is drawn off from the bottom of the column at outlet 42. A series of pump arounds 44 and 46 are used at different elevations on the column 32 to circulate the hydrocarbon flow to control temperature and move the cooling liquid down the column 32. Each of these streams drawn off from the column 32, including the pump around fluid, can be used in the heat exchanger shells for heat transfer with the incoming crude.

The heat exchangers typically take heat from other process streams that require cooling before being further processed. Heat is also exchanged against condensing streams from the column 32. For example, the heat exchangers 16 and 18 disposed at the upstream end of the pre-heat train 10 may receive kerosene fed from outlet 36 and fluid from the top pump around 44, respectively, which are relatively cooler than the other process streams. The heat exchangers 22, 24, 26, and 28 disposed downstream of the pre-heat train 10 may receive heavy oil gas from outlet 38, light oil gas from outlet 40, fluid from the bottom pump around 46 and reduced crude from outlet 42, respectively, as these fluids are progressively hotter. It can be appreciated that the heat exchangers disposed downstream in the pre-heat train 10, for example the heat exchanger 28 directly adjacent to the furnace 30, need to run at the highest temperatures in order to effectively heat the crude oil stream to a suitable temperature before it is fed to the furnace 30. By this, the furnace 30 can operate more efficiently and deliver the crude oil stream to the distillation column 32 at the appropriate operating temperature to effect fractionation. All of the heat required to drive the distillation column 32 must be generated by the pre-heat train 10, including the furnace 30.

The inventors of this application have discovered that anti-fouling mechanisms are more effective when deployed at certain sections in the pre-heat train. The anti-fouling mechanisms include hardware solutions that use smooth, corrosion resistant surfaces that resist the adherence of potential foulants. The anti-foulant mechanisms also include applied vibration that disrupts the boundary layer and lifts potential foulants away from the exchanger surface. These mechanisms can be used alone or in combination.

The critical location of the anti-foulant mechanisms is in the downstream section or late pre-heat train. The heat exchangers in the late pre-heat train operate at higher temperatures, especially those close to the furnace. Harder deposits tend to form in exchangers operating at higher temperatures. The inventors have discovered that anti-fouling application in the late pre-heat train results in the greatest reduction in furnace firing, which is an operating cost saving, versus the energy recovery per exchanger. The greatest benefit for using a modified exchanger with anti-foulant properties is at or near the hottest end of the pre-heat train 10. FIG. 1 symbolically shows an anti-fouling mechanism 50 disposed in the hottest heat exchanger 28 that is positioned directly adjacent to the furnace 30.

Figure 2:
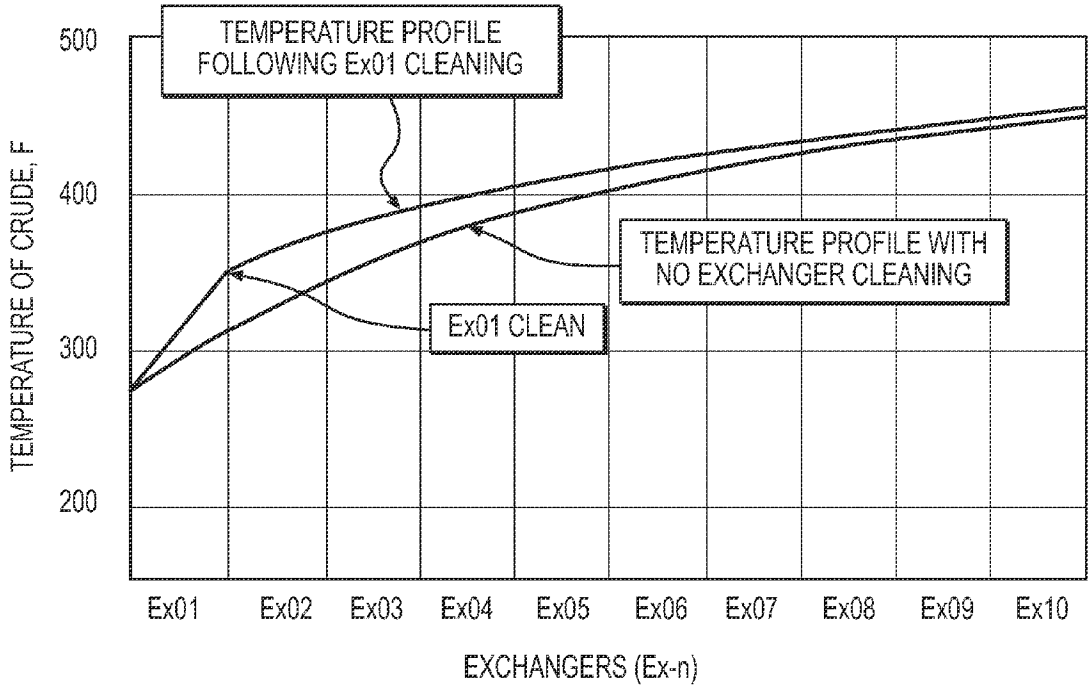
FIG. 2 is a graph showing a temperature profile of a series of heat exchangers with no cleaning and a temperature profile of the series if a first heat exchanger in the series is cleaned.

FIG. 2 illustrates the effect of cleaning the upstream end of a pre-heat train compared to not cleaning any exchangers in a pre-heat train. The temperature profile of the crude oil as it would progress through a train of ten exchangers is seen to gradually increase with the greatest temperature gain at the upstream end. If the first heat exchanger in the train is cleaned, the temperature profile is seen to more steeply increase after the cleaning and then level off to a similar degree as the uncleaned train.

Figure 3:
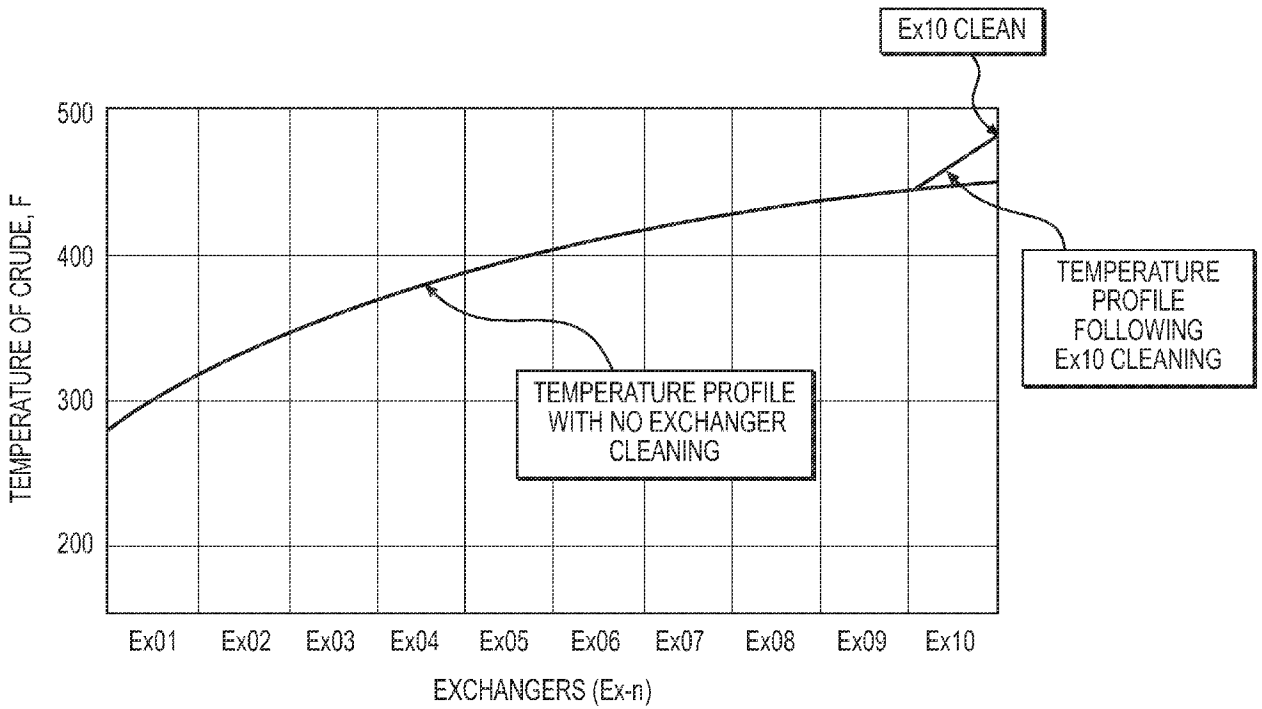
FIG. 3 is a graph showing a temperature profile of a series of heat exchangers with no cleaning and a temperature profile of the series if a last heat exchanger in the series is cleaned.

FIG. 3 illustrates the effect of cleaning the downstream end of a pre-heat train compared to not cleaning any exchangers in a pre-heat train. The temperature profile of the crude oil as it would progress through a train of ten exchangers is seen to gradually increase with the greatest temperature gain at the upstream end. If the last heat exchanger in the train is cleaned, the temperature profile is seen to significantly increase after the cleaning and end at a higher temperature than when the first heat exchanger is cleaned, as illustrated in FIG. 2. This illustrates that the largest benefit of anti-fouling would be experienced at the end of the pre-heat train. In accordance with this invention, if the modified exchanger is located at the hot end versus the cold end of the train, a larger heat duty improvement in the exchanger would be passed on as an increase in the coil inlet temperature to the furnace. This would reduce fuel firing in the furnace and energy consumption. The increased benefit would permit a greater investment for upgrading the exchanger.

Figure 4:
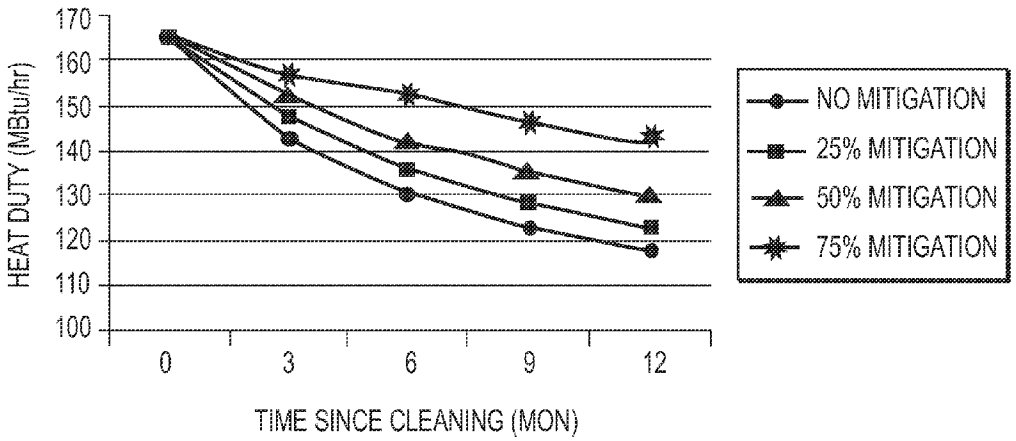
FIG. 4 is a graph that illustrates a fraction of heat recovery realized if mitigation performance is high; and, FIG. 5 is a graph that illustrates the impact that deposits have on heat loss over time.

The first layers of a fouling deposit on an exchanger surface have the most significant impact on the heat exchange efficiency. As seen by the example in FIG. 4, heat duty losses fall from 165 MBtu/hr to 118 MBtu/hr over 12 months with no mitigation of fouling. With increased mitigation, heat losses are reduced. However, decline of heat exchange will remain substantial even if some form of prevention or cleaning is applied to limit deposits to just 50% of the uncleaned state. Mitigation should be very high in order to stave off significant heat losses. As seen in FIG. 4, with 75% mitigation, less significant losses can be experienced, for example from about 165 MBtu to about 142 MBtu.

To achieve a goal of greater than 80% recovery of energy lost due to fouling, fouling mitigation should be very high, preferably 90% or greater. Such high rates of mitigation can be achieved by using smoothed corrosion resistant heat exchange surfaces. A suitable surface is an electro-polished 304 bright annealed stainless steel bundle of tubes in a shell and tube heat exchanger. Using such a bundle, fouling factors (Rf) of less than 0.002 hr-ft$^2$-° F./Btu may be sustained over many months in late train service. This can be compared to typical late train exchanger Rf values of 0.04 or greater. It can be appreciated that if this level of performance is applied to the hot-end exchangers in the late pre-heat train a significant benefit in heat recovery can be achieved with a small fraction of the exchangers using the anti-foulant mechanisms.

Figure 5:
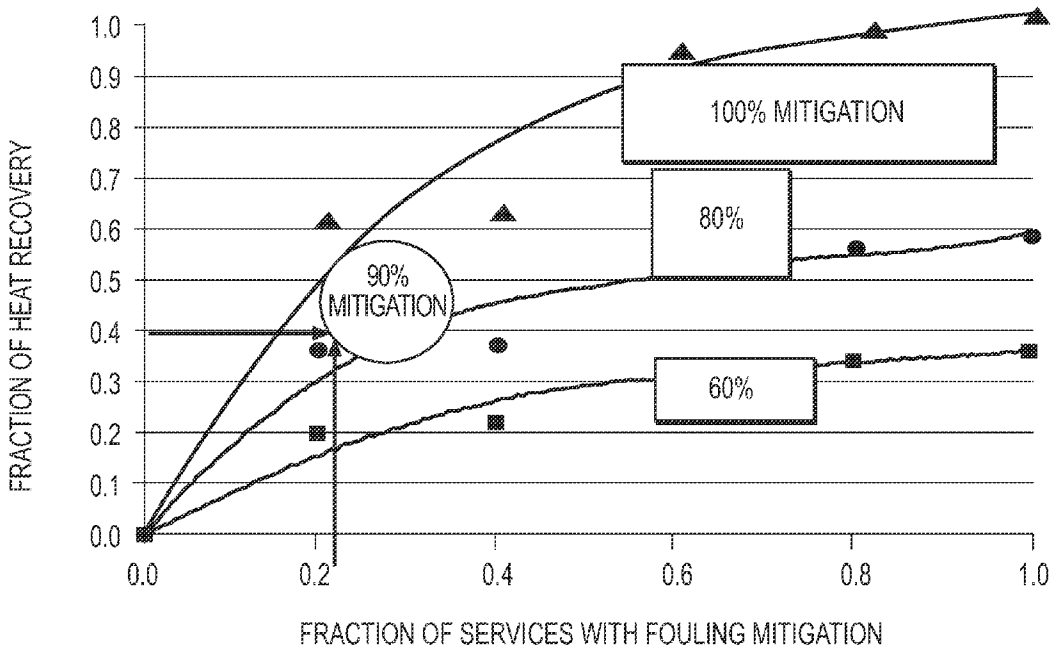

FIG. 5 illustrates this concept. The graph shows that mitigating fouling by 90% in just 25% of the exchangers in the train would recover 40% of the energy lost due to fouling. This would exceed the recovery of energy that is possible if the whole train is modified using technology that achieves only 60% mitigation of fouling deposits. The inventors have discovered the benefits of utilizing anti-foulant technology with a very high percentage of deposit mitigation in a site specific application. This maximizes the value of the technology. Effective modification of late train exchangers also will benefit the shell side of the heat exchangers and will show beneficial shell side economics, such as those factors associated with vacuum residuum run-down temperatures that can be limiting.

In a practical application, bundles of corrosion resistant smoothed tubes are deployed in the late pre-heat train to significantly reduce the formation of harder deposits. Vibration can be used as an adjunct approach in conjunction with the corrosion resistant, smooth tubes, or deployed alone on existing bundles, made of CS or 5Cr, for example. Using this approach, as much as 90% of all heat losses due to fouling in a crude unit pre-heat train may be able to be recovered. Thus, the use of high performing, more durable exchangers in these select locations would justify the increased cost of these components.

Other anti-foulant mechanisms may be used as well. Tubes with surfaces that are electro-polished and other forms of smooth corrosion-resistant surfaces may be used. Various types and modes of vibration may be used, including using actuators to apply mechanical and/or acoustical vibration.

So, in accordance with this invention, the pre-heat train will include a plurality of heat exchangers in which only some or one of the heat exchangers will include an anti-fouling mechanism. The anti-fouling mechanism will be selectively provided to those heat exchangers in which a reduction of heat loss will have the most impact on the overall operation. For example, at least the hottest heat exchanger can include the anti-fouling mechanism. At least the heat exchanger directly adjacent to the furnace can include the anti-fouling mechanism. The heat exchangers in the late-train can include the anti-fouling mechanism. Fewer than half of the heat exchangers, preferably 40% or less of the heat exchangers, can include the anti-fouling mechanism. Moreover, the anti-fouling mechanism can be selected based on its extent of fouling mitigation. The selected anti-fouling mechanism preferably operates at at least 50% mitigation, more preferably at least 75%, and most preferably at least 90% mitigation. By this, the overall energy recovery can be increased as compared to an entire train of heat exchangers with anti-fouling mechanisms with less effective mitigation of fouling deposits.

An analysis of where and to what extent to provide the anti-fouling mechanism can also include an economic analysis. For example, a life-cycle benefit/cost analysis can be conducted to determine whether the benefit of using the technology justifies the cost.

It is possible to apply this concept to any operating unit that experiences fouling in heat exchangers, particularly other operating units in a refinery or petrochemical processing operation.

Various modifications can be made in the invention as described herein, and many different embodiments of the device and method can be made while remaining within the spirit and scope of the invention as defined in the claims without departing from such spirit and scope. It is intended that all matter contained in the accompanying specification shall be interpreted as illustrative only and not in a limiting sense.

What is claimed is:

1. A crude oil processing system, comprising:

a plurality of heat exchangers defining a pre-heat train arranged along a crude oil flowpath having an upstream end and a downstream end for progressively heating a flow of crude oil; and a furnace for heating the crude oil for processing, wherein the furnace is disposed at the downstream end of the crude oil flowpath at the end of the pre-heat train, wherein the portion of the pre-heat train disposed adjacent to the furnace at the downstream end of the flowpath includes a heat exchanger having an anti-fouling mechanism and the remaining portion of the pre-heat train includes a heat exchanger having no anti-fouling mechanism.

2. The crude oil processing system of claim 1, wherein the plurality of heat exchangers include tube and shell type heat exchangers and the anti-fouling mechanism includes a tube bundle made of corrosion resistant smoothed tubes.

3. The crude oil processing system of claim 1, wherein the anti-fouling mechanism includes a heat exchange surface that is made of smoothed corrosion resistant material.

4. The crude oil processing system of claim 3, wherein the anti-fouling mechanism includes a vibration applicator.

5. The crude oil processing system of claim 1, wherein the anti-fouling mechanism includes a vibration applicator.

6. The crude oil processing system of claim 1, wherein at most 40% of the heat exchangers in the pre-heat train have anti-fouling mechanisms.

7. The crude oil processing system of claim 1, wherein the heat exchanger in the pre-heat train at the downstream end directly adjacent to the furnace has the anti-fouling mechanism.

8. The crude oil processing system of claim 1, wherein the anti-fouling mechanism mitigates fouling by at least 75%.

9. The crude oil processing system of claim 1, wherein the anti-fouling mechanism mitigates fouling by about 90%.

10. The crude oil processing system of claim 1, wherein the heat exchanger in the pre-heat train that experiences the highest temperature in the pre-heat train has the anti-fouling mechanism.

11. The crude oil processing system of claim 1, further comprising a desalter disposed along the flowpath between at least two of the heat exchangers.

12. The crude oil processing system of claim 1, further comprising a distillation tower disposed downstream of the furnace, wherein the crude oil heated by the furnace is directly fed to the distillation tower for fractionation.

13. The crude oil processing system of claim 12, wherein the heat exchangers are in fluid communication with the distillation tower and process streams drawn from the distillation tower are routed through at least some of the heat exchangers.

14. The crude oil processing system of claim 1, in combination with a refinery.

* * * * *